US005173020A

United States Patent [19]

Ebbing et al.

[11] Patent Number: 5,173,020

[45] Date of Patent: Dec. 22, 1992

[54] COLLECTOR SILENCER FOR A CENTRIFUGAL COMPRESSOR

[75] Inventors: Charles E. Ebbing, Fayetteville; Thomas M. Zinsmeyer, Pennellville; Edson H. Byrns, Dewitt, all of N.Y.

[73] Assignee: Carrier Corporation, Syracuse, N.Y.

[21] Appl. No.: 656,537

[22] Filed: Feb. 19, 1991

[51] Int. Cl.[5] ..... F01D 5/10

[52] U.S. Cl. ..... 415/119; 415/214.1; 415/196; 181/202; 181/403; 29/888.024

[58] Field of Search ..... 415/119, 182.1, 196, 415/214.1; 29/888.024, 888.025; 181/202, 209, 403, 219

[56] References Cited

U.S. PATENT DOCUMENTS

| | | | |
|---|---|---|---|
| 2,773,553 | 12/1956 | Heurich et al. | 415/119 |
| 4,347,043 | 8/1982 | Morris | 181/202 |
| 4,573,879 | 3/1986 | Uetuji et al. | 181/403 |
| 4,680,006 | 7/1987 | Fisher | 415/119 |
| 4,729,723 | 3/1988 | Outzen | 181/403 |
| 4,886,415 | 12/1989 | Engelberger et al. | 415/119 |

FOREIGN PATENT DOCUMENTS

| | | | |
|---|---|---|---|
| 556550 | 8/1932 | Japan | 415/119 |
| 0123395 | 9/1980 | Japan | 415/119 |
| 0093998 | 5/1984 | Japan | 415/119 |
| 0031699 | 2/1986 | Japan | 415/119 |
| 1198138 | 7/1970 | United Kingdom | 181/403 |

*Primary Examiner*—Thomas E. Denion

[57] ABSTRACT

A centrifugal compressor is provided with a collector for receiving refrigerant from the diffuser, and sound absorbent segments are placed within the collector and retained in place against one wall thereof. One method of retention is by way of a ring and a plurality of spring clip members. The silencer segments and the retaining ring and spring clip members are placed into the collector prior to installation of the diffuser. As the diffuser is attached to the collector, one edge engages a side of the ring so as to axially move it into its final fixed position, while at the same time causing the attached spring clip members to be placed in tension against the silencer segments to secure them in place.

19 Claims, 3 Drawing Sheets

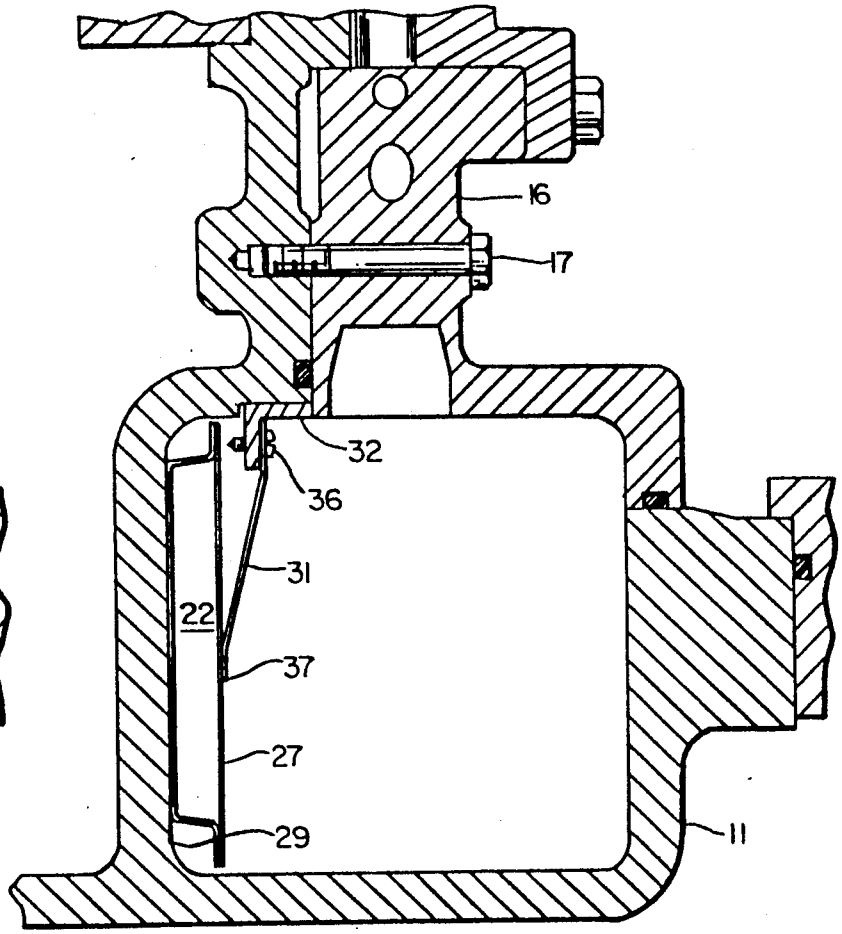
FIG.7
FIG.5
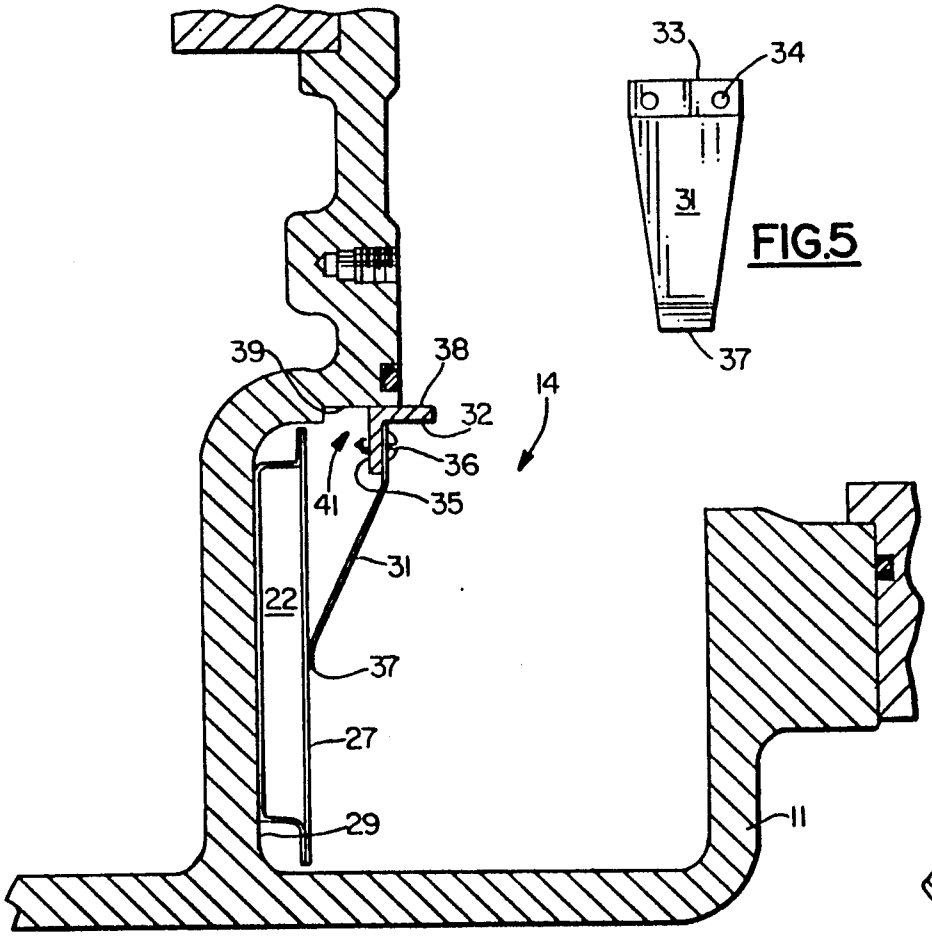
FIG.6

COLLECTOR SILENCER FOR A CENTRIFUGAL COMPRESSOR

BACKGROUND OF THE INVENTION

This invention relates generally to centrifugal compressors and, more particularly, to a method and apparatus for locating a silencer device in the collector of a centrifugal compressor.

Centrifugal compressors, of the type which are used for large air conditioning systems, have a number of included components which create sound and vibration that radiates from the compressor and attached components including the motor, gearing, condenser and evaporator shells and the discharge line. In addition to design considerations that tend to minimize these sounds, it is common practice to reduce the sound by way of external, surface applied lagging materials or the addition of internal discharge line silencers (i.e. and acoustically absorptive material such as fiber glass, mineral fiber, or Dacron) which are placed in the discharge line of the compressor. The usual approach for installing a silencer device in the discharge pipe of a compressor is by securing the entire assembly to the inner sidewalls of the discharge pipe by welding or the like. Because of the relatively small size of the discharge pipe and the desirability for placement of the silencer in axial locations within the pipe, the accessibility is severely limited and thereby complicates the process. Further, when welding is performed in close proximity to the absorptive material within the silencer device, as is usually required, the absorptive material may be damaged by the resulting heat.

Rather than installing a silencer device directly in the discharge pipe, another approach is to remove a portion of the discharge pipe and install a complete replacement section comprising a pipe-like structure with the silencer device installed therein. Such a unit has customarily been attached by way of mating flanges. Such an approach is therefore relatively expensive, involving both extensive expenditures of time and material.

A dominant noise source in most centrifugal chillers is the noise produced in the discharge gas stream by the compressor impeller. It would therefore be desirable to strategically locate a suitable absorbing material such that a large percentage of this noise can be absorbed before it reaches the discharge line. To do so it would be necessary to place absorbing material either in the diffuser or in the discharge chamber commonly referred to as the volute. However, the volute has the same problems of accessibility as does the discharge tube. Not only is it difficult to place the absorptive material within the volute, but it is made more difficult by the need to securely retain the absorptive material in circumferentially spaced locations within the volute. In this regard, in addition to the problem of accessibility as discussed hereinabove, conventional methods of fastening the parts in place are not practical for other reasons. First, the discharge chamber is a pressure containing member so that the forming of holes through the wall for attachment are not desirable. Secondly, the pressure chamber is normally made from cast iron, and welding of cast iron is impractical. Thirdly, the use of an adhesive is difficult because of its likely incompatibility with refrigerant. Finally, the apparatus for retaining any such sound absorbing material within a discharge chamber must be capable of allowing self adjusting or a shifting in the position of the silencer parts as they "bed themselves in" against the relatively rough wall within the discharge chamber.

It is therefore an object of the present invention to provide an improved centrifugal compressor silencer apparatus and method of installation.

Another object of this invention is the provision for securing a silencer device within a discharge chamber of a centrifugal compressor.

Yet another object of the invention is the provision for securing a silencer in the discharge chamber of a centrifugal compressor without the use of welding or adhesives.

Still another object of the present invention is the provision in a centrifugal compressor discharge chamber for allowing a silencer device to "bed itself in" during operation.

Still another object of the present invention is the provision for installing a silencer in a centrifugal compressor in an effective, efficient and economical manner.

These objects and other features and advantages become more readily apparent upon reference to the following description when taken in conjunction with the appended drawings.

SUMMARY OF THE INVENTION

Briefly, in accordance with one aspect of the invention, a plurality of silencer elements are disposed within the discharge chamber of a centrifugal compressor. The elements are installed and secured within the chamber in such a way as to require no welding, no adhesive, and preferably, no forming of holes in the chamber wall. Provision is made for self adjustment as the silencer elements "bed themselves in" against the relatively rough wall of the discharge chamber.

In accordance with another aspect of the invention, the discharge chamber comprises a collector having a substantially uniform cross sectional size and shape throughout its circumference. Accessibility is gained by way of a relatively narrow, annular opening that exits in the discharge chamber prior to assembly with the diffuser apparatus.

By yet another aspect of the invention, the silencer elements are secured in place adjacent a radially extending wall by way of circumferentially spaced biasing elements which are secured in place by a ring that is assembled within an annular channel on an inner circumference of the discharge chamber. The flexibility of the biasing elements allows for slight positional readjustment as the silencer elements "bed" themselves against the wall of the discharge chamber.

In the drawings as hereinafter described, a preferred embodiment and modified embodiments are depicted; however, various other modifications and alternate constructions can be made thereto without departing from the true spirit and scope of the invention.

BRIEF DESCRIPTION OF THE DRAWINGS

FIG. 5 is a front view of the spring member portion of the present invention.

FIG. 6 is a cross sectional view of the present invention in an intermediate stage of installation.

FIG. 7 is a cross sectional view thereof in the final stage of installation.

DESCRIPTION OF THE PREFERRED EMBODIMENT

Figure 1:
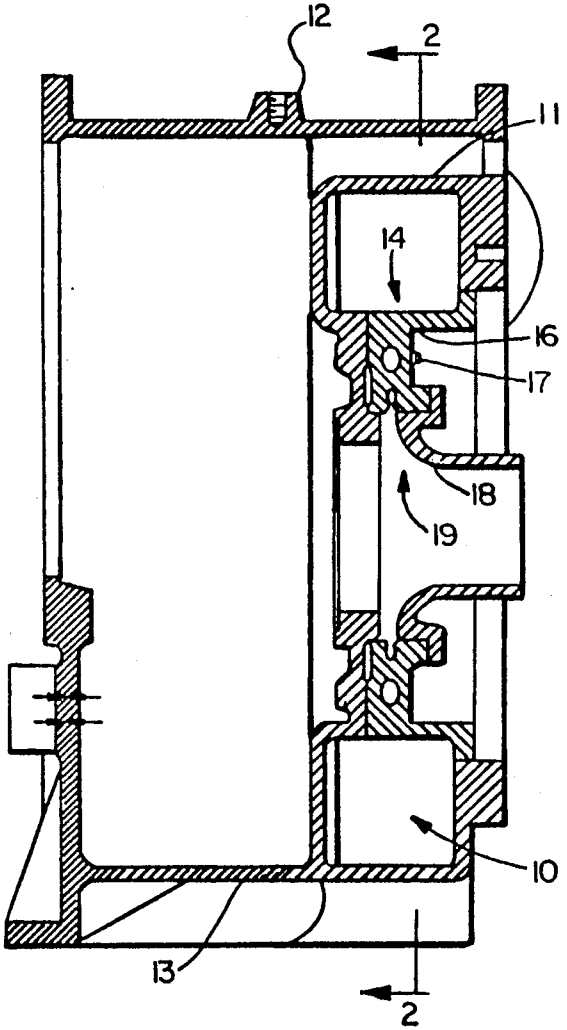
FIG. 1 is a longitudinal cross sectional view of the collector portion of a centrifugal compressor with the present invention incorporated therein.

Referring now to FIG. 1, the invention is shown generally at 10 as incorporated into a discharge chamber, or collector structure 11 for a centrifugal compressor 12. The collector structure 11 forms an integral part of the compressor base structure 13 and has a substantially rectangular cross sectional shape throughout it circumference as shown. The annular opening 14 at its radially inner circumference is closed by way of an annular diffuser structure 16 which is secured in place by a plurality of fasteners 17. A shroud structure 18 is then installed in abutting relationship with the diffuser 16 by a suitable fasteners to form the outer boundary of a passage 19 for refrigerant to be compressed by the impeller (not shown) located on the same axis. In operation, the refrigerant is drawn into the shroud 18 and compressed by the impeller, whereupon it passes through the diffuser 16 where the kinetic energy is converted to pressure energy. The diffused refrigerant vapor then enters the collector structure 11 and passes by way of a discharge pipe 21, (FIG. 2) to the condenser.

Figure 2:
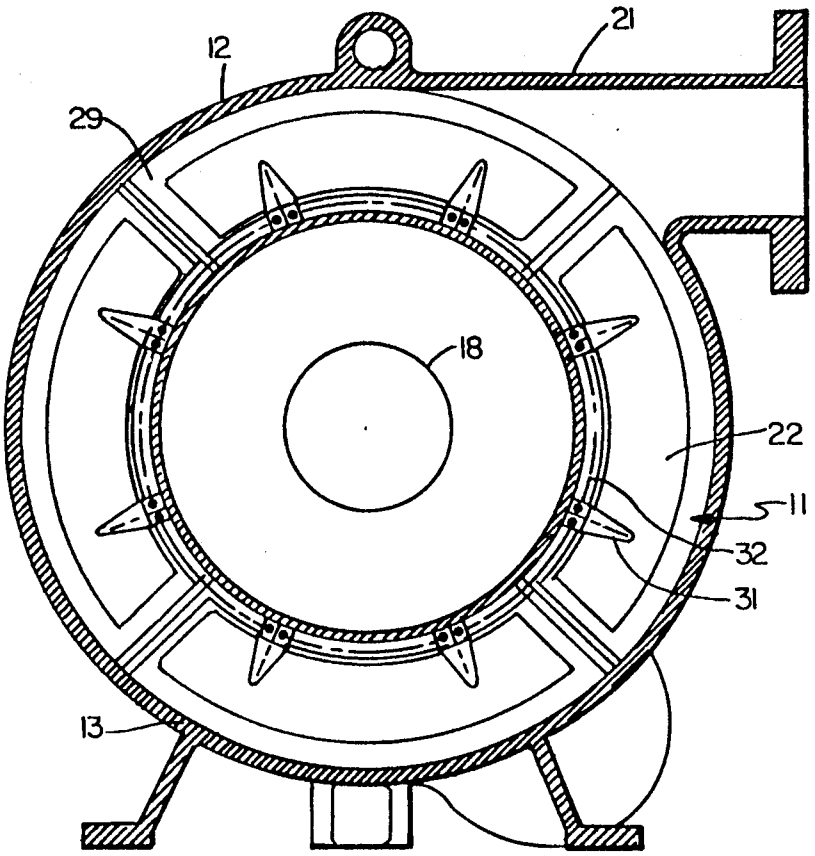
FIG. 2 is an axial cross sectional view thereof as seen along line 2—2 of FIG. 1.
Figure 4:
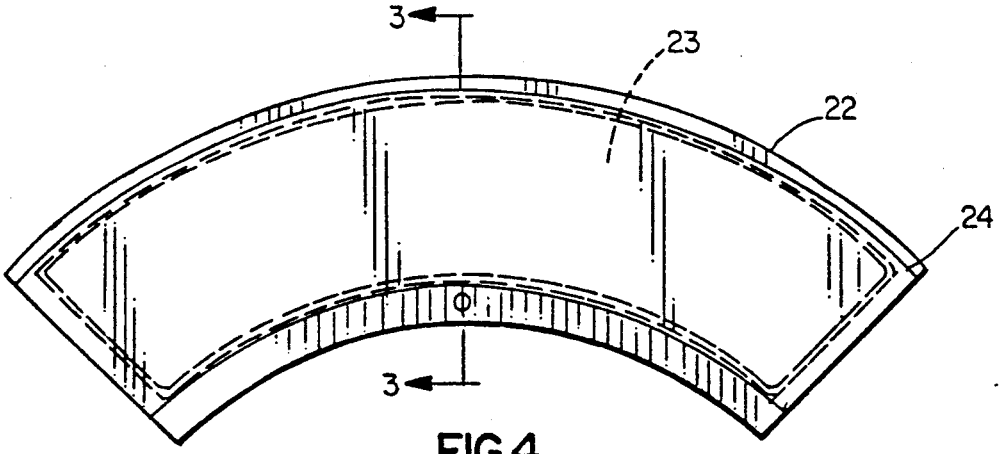
FIG. 4 is a front view thereof.
Figure 3:
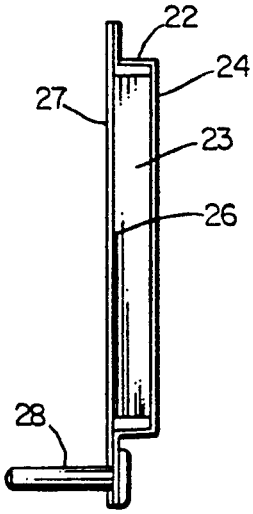
FIG. 3 is an end view of a silencer segment assembly portion thereof.

Referring now to FIG. 2, there is shown the silencer apparatus of the present invention as installed in the collector 11. The silencer segments 22, one at which is shown in greater detail in FIGS. 3 and 4, are preferably arcuate in form and are circumferentially disbursed around the collector structure 11 as shown. Each comprises a sound absorbent pad assembly 23 which is sandwiched between a casing 24 on one side thereof, and a screen 26 and a perforated plate 27 on the other side thereof. An alignment pin 28 may be provided to circumferentially fix the position of the installed assembly within the discharge chamber 11 as will be more fully discussed hereinafter.

As shown in FIG. 2, the silencer segments 22 are held in place against the inner side of a radially extending wall 29 of the collector 11 by a plurality of spring clips 31, which are in turn held in place by a compression ring 32. These elements are shown in greater detail in FIGS. 5–7.

As will be seen by reference to FIGS. 5 and 6, each of the spring clips 31 is generally trapezoidal in shape and has one end 33 which is secured to the compression ring 32 by way of openings 34 and 35, and fasteners 36. The other end 37 is adapted to engage the perforated plate 27 side of the silencer segment 22 so as to biasingly urge it against the collector wall 29 as shown. A material which has been found suitable for use in the spring clip 31 is 20 gauge carbon spring steel.

The compression ring 32 is L-shaped in cross section as shown and is dimensioned such that its radially outer surface 38 loosely engages an annular surface 39 of a channel 41 formed in the collector structure 11 as shown. The method of installation will be more fully described hereinafter.

Figure 8:
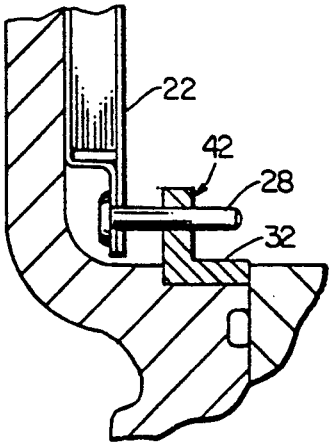
FIG. 8 is a cross sectional view thereof showing the alignment pin therefor.

In addition to the circumferentially spaced openings 35 that are formed in the compressor ring 32 for the purpose of attaching the spring clips 31, a plurality of openings 42 (see FIG. 8) are provided for receiving the alignment pins 28 for specifically locating the silencer segments 22 in their installed positions within the collector 11.

Referring back to FIGS. 6 and 7, the method of installation will now be described. As will be seen in FIG. 6, before the diffuser 16 is assembled in place, the annular opening 14 provides access to the inner wall 29 of the collector 11. The compression ring 32, together with the spring clips 31 which have been attached by way of fasteners 36, can be easily placed in position within the channel 41 as shown. In this condition, the end 37 of the spring clip is engaging the silencer segments 22, which have earlier been placed in the desired position against the collector wall 29. At this point, however, there is little, if any, tension in the spring clips 31. The spring loading step occurs only with the next step as shown in FIG. 7. Here, the diffuser 16 is moved into place to cover the opening 14. As this is done, its inner edge engages the outer edge of the ring 32 and moves it axially inwardly within the channel 41. As this occurs, the tension on the spring clips increases to thereby bias the silencer segments 22 in their installed positions against the collector wall 29.

Figure 10:
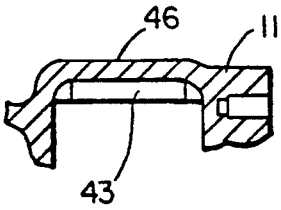
FIG. 10 is a longitudinal view thereof.
Figure 9:
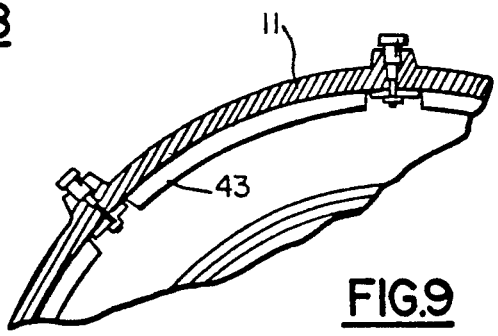
FIG. 9 is an axial cross sectional view of a modified embodiment of the present invention.
Figure 11:
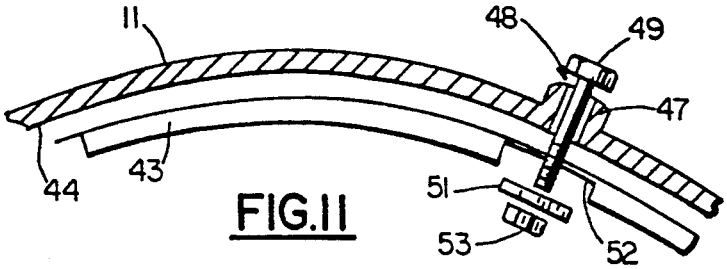
FIG. 11 is an axial exploded view of a portion thereof.

Referring now to FIGS. 9–11, a modified embodiment of the present is shown to include a plurality of modified silencer segments 43 circumferentially disbursed and located on the inner surface 44 of a radially outer wall 46 of the collector 11. The silencer device 43 is of substantially the same structure as that shown in FIGS. 3–4 except that its shape is curved to fit the radially outer wall 44 rather than the radially extending wall 29. The method and apparatus for retaining the modified silencer segments 43 is similar to that for retaining the segments 22, in that they are installed against a wall of the collector 11 before the diffuser element 16 is installed. However, the specific method and apparatus for attaching the modified silencer segments 43 are different as shown in FIG. 11. Here, the collector 11 is provided with a plurality of bosses 47 with openings 48 passing through the shell of the collector 11. A bolt 49 is then placed into each of the openings 48, and after passing through a flat retainer 51, which retainingly engages the end extensions 52 of the adjacent silencer segments 43, is threaded into a nut 53 for securing the silencer segments 43 in their installed positions.

While the present invention has been disclosed with particular reference to preferred and modified embodiments thereof, the concepts of this invention are readily adaptable to other embodiments, and those killed in the art may vary the structure thereof without departing from the essential spirit of the invention.

What is claimed is:

1. An improved centrifugal compressor of type having an impeller for accelerating refrigerant gas to a high velocity, a diffuser for converting a kenetic energy of the gas to pressure energy, and a discharge chamber for receiving the decelerated gas from the diffuser for further transfer to a condenser, wherein the improvement comprises;

a plurality of sound absorbent elements disposed in the discharge chamber for absorbing sound that is transmitted thereto; and retaining means for retaining said elements in substantially fixed positions within the discharge chamber.

2. An improved centrifugal compressor as set forth in claim 1 wherein said plurality of sound absorbent elements are secured against a radially extending side wall of the discharge chamber.

3. An improved centrifugal compressor as set forth in claim 1 wherein said plurality of sound absorbent elements are circumferentially spaced within the discharge chamber.

4. An improved centrifugal compressor as set forth in claim 1 wherein said plurality of sound absorbent elements are arc shaped segments which are retained against a wall of the discharge chamber.

5. An improved centrifugal compressor as set forth in claim 1 wherein the discharge chamber comprises a collector which is substantially symmetrical in circumferential cross section.

6. An improved centrifugal compressor as set forth in claim 1 wherein said retaining means comprises;

a ring disposed within the discharge chamber;

means for securing said ring in a substantially fixed position therein; and a plurality of biasing members, each being attached at one end to said ring and extending therefrom to engage a side of one of said sound absorbent elements so as to bias it against a wall of the discharge chamber.

7. An improved centrifugal compressor as set forth in claim 6 wherein said ring is disposed adjacent and axially secured to an axially extending wall of the discharge chamber and said biasing members extend radially from said ring to axially bias said sound absorbent elements against the radially extending side wall of the discharge chamber.

8. An improved centrifugal compressor as set forth in claim 7 wherein said ring is disposed adjacent a radially outer wall of the discharge chamber and said plurality of biasing members extend radially inwardly therefrom.

9. An improved centrifugal compressor as set forth in claim 6 wherein said ring is L-shaped in axial cross section.

10. An improved centrifugal compressor as set forth in claim 6 wherein said retaining means includes a separate interconnection between said sound absorbent elements and said ring so as to prevent relative rotational movement.

11. An improved method of installing a silencer apparatus into a centrifugal compressor of the type having in serial flow relationship, an impeller, a diffuser and a discharge chamber, wherein the improvement comprises the steps of;

providing a discharge chamber with an annular opening formed therein;

inserting a plurality of silencer segments into said annular opening and placing said segments against a wall of said discharge chamber;

securing said silencer segments to said discharge chamber wall; and closing said annular opening by attaching the diffuser to said discharge chamber.

12. An improved method as set forth in claim 11 when said discharge chamber is provided with an annular opening on a radially inner side thereof.

13. An improved method as set forth in claim 11 wherein the wall against which said segments are placed is a radially extending wall.

14. An improved method as set forth in claim 11 wherein the securing and closing steps are accomplished by the following steps:

inserting a ring partially through said annular opening with said ring having an annular projecting portion thereon;

attaching a plurality of spring members at their one ends to said ring projecting portion such that the spring other ends engage another side of said silencer segment; and installing a diffuser structure over said annular opening in such a manner as to simultaneously engage a side of said ring and cause it to be completely inserted in said annular opening, while at the same time causing said plurality of spring members to be placed in tension so as to bias said silencer segments against said discharge chamber wall.

15. An improved method as set forth in claim 14 wherein, during the ring insertion step, said ring engages an axially extending portion of said collector wall.

16. An improved method as set forth in claim 15 and including an additional step of forming an annular channel in said discharge chamber wall, with the channel having an axially extending surface.

17. An improved method as set forth in claim 14 wherein said spring members comprise leaf springs.

18. An improved method as set forth in claim 14 wherein said plurality of spring members are attached to said ring projecting portion by way of fasteners.

19. An improved method as set forth in claim 14 and including an additional step of providing an alignment pin interconnecting said ring with said silencer segments so as to prevent relative rotational movement therebetween.

* * * * *